United States Patent [19]

Christopher

[11] Patent Number: 4,831,277

[45] Date of Patent: May 16, 1989

[54] REMOTE POWER SYSTEM

[76] Inventor: Nicholas S. Christopher, 2 Pleasant St., South Natick, Mass. 01760

[21] Appl. No.: 84,102

[22] Filed: Aug. 11, 1987

[51] Int. Cl.[4] ..... F02B 63/04

[52] U.S. Cl. ..... 290/1 A; 290/1 R

[58] Field of Search ..... 290/1 R, 1 A, 1 B, 2, 290/40; 123/3

[56] References Cited

U.S. PATENT DOCUMENTS

| | | | |
|---|---|---|---|
| 3,412,258 | 10/1968 | Satter | 290/40 |
| 3,683,255 | 11/1972 | Schroeder | 320/2 |
| 3,921,052 | 2/1975 | Milano | 290/50 X |
| 4,057,736 | 1/1977 | Jeppson | 290/1 R X |
| 4,228,361 | 5/1980 | Jacobs et al. | 290/44 |
| 4,535,252 | 9/1985 | Jacobs et al. | 290/44 |
| 4,661,761 | 4/1987 | Katsumata | 290/1 R X |
| 4,665,319 | 5/1987 | Seepe et al. | 290/1 B X |
| 4,702,201 | 10/1987 | Odo et al. | 290/1 A X |
| 4,715,192 | 12/1987 | Katz | 290/2 X |

OTHER PUBLICATIONS

Producing Your Own Power, edited by Carol Hupping Stoner, Rodale Press, Inc., pp. 48–52.

*Primary Examiner*—William M. Shoop, Jr.
*Assistant Examiner*—W. E. Duncanson, Jr.
*Attorney, Agent, or Firm*—Karen M. Gerken; Martin P. Hoffman; Mitchell B. Wasson

[57] ABSTRACT

A power system specifically adapted to provide DC power for powering a DC load at a remote site under severe environmental conditions, such as is found at remote gas pipeline locations. The power system includes a slow speed heat engine adapted to be powered by fuel, preferably taken directly from the gas pipeline, the supply of which is controlled by means of a pressure regulator. The engine is adapted to be directly coupled to an oversized, slow speed three-phase alternator so as to produce AC power, which is subsequently rectified to DC power output for powering a load in the range of 500 to 5,000 watts. The engine is particularly adapted to be started with a hand crank or a portable starter, and is provided with ceramic main bearings, an oversized lubrication system, redundant independent ignition systems and a highly superior cooling system. The cooling system includes a variable speed fan, the operation and speed of which is adapted to be automatically controlled in response to a sensed engine temperature for purposes of maintaining the engine temperature at a particular level. A rotary magnetic encoder system is provided for sensing the engine speed and for controlling the pressure regulator in response to the sensed speed to achieve optimum engine speed. Redundant safety shutdown systems are adapted to shut down the engine upon the occurrence of certain critical events. The remote power system is characterized by long life, minimal maintenance requirements and a mean time between failure equal to or in excess of 20,000 hours.

20 Claims, 3 Drawing Sheets

REMOTE POWER SYSTEM

BACKGROUND OF THE INVENTION

1. Field of the Invention

The invention pertains broadly to a system for providing electrical power. More particularly, the invention is directed to an electrical power system particularly adapted for operation at remote sites.

Although its attributes lend it favorably to numerous applications, the invention is specifically adapted for continuous operation along a gas pipeline or at a gas well, providing electrical power for performing functions related to telecommunications, telecontrol, cathodic protection, supervisory control, data acquisition and remote gate valve sensing and activation in conformance with the International Natural Gas Pipeline Safety Regulations.

The remote sites associated with gas pipeline applications are typically characterized by harsh environments, including high temperatures, corrosive atmospheres and dusty air conditions. The latter factors present serious reliability concerns for power generation systems, contributing to high failure rates and high costs due to equipment repair and replacement. Moreover, the general remoteness of the power system along a gas pipeline or at a gas well, in conjunction with known reliability deficiencies, result in significant maintenance costs, arising from the inherent necessity for frequent maintenance visits to insure system integrity.

The relatively poor reliability of some conventional remote site power generators is particularly problematic in view of the criticality of the functions to be performed by the power system. Additionally, the probability of failure and future costly repair associated with some conventional remote site power generation systems present obvious negative financial implications relating to the life cycle costs for the system. Life cycle costs for a conventional system can be expected to increase, not only directly as a result of the costs of failure and repair, but also indirectly as a result of probable interruptions in the overall gas pipeline operation and support functions. The need to adopt a frequent maintenance scheme further contributes to high life cycle costs, severely limiting the utility of conventional power systems in remote site applications.

The remote power system of the present invention is uniquely characterized by low first cost, high reliability and efficiency, long life, low life cycle costs and minimal maintenance requirements over a 500 watt to 5,000 watt power output range. For loads between 500 and 5,000 watts, the low initial cost of the present power system makes it more attractive than competitive power generators. With its characteristic high efficiency, reduced maintenance costs and longer component lifetimes, the twenty-year life cycle costs for the subject invention are significantly lower than presently available conventional power generators. Furthermore, in gas pipeline applications, the power system of the present invention is adapted to derive its fuel directly from the natural gas pipeline, thereby affording almost-free fuel costs while eliminating related and often unpredictable fuel logistics costs.

The present invention is designed in conformance with the latest U.S. Military Reliability and Maintainability (R&M) 2000 Program, which emphasizes a "Back to Basics" approach for achieving superior reliability and easy maintenance in power systems through proven straightforward practical methods. In order to obtain a high level of reliability in combination with very low levels of maintenance, the recommendations of the International Telecommunication Union for the primary power supply of remote telecommunication systems are also incorporated into and, indeed, even exceed with the present remote power system design. Adhering to the fundamental design concepts of simplicity, ruggedness and internal redundancy, the remote power system is capable of providing the maximum possible energy availability to the load, while avoiding the high cost of field repairs.

Unlike other remote power sources on the market, the subject remote power system was developed to solve the problems of the user, and is therefore the first remote power product that is market driven rather than technology driven. Its characteristic high reliability and attractive life costing parameters address the requirements of the remote power system user, being perfectly adapted to gas pipeline applications. It is to be understood, however, that the invention is ideally suited to the entire remote site power system market where high reliability and minimal maintenance are essential, even where natural gas is not available and gasoline or diesel fuel must be transported to the site.

The remote power system of the present invention broadly includes a very slow speed heat engine directly coupled to an equally slow running oversized alternator. The engine is adapted to run on a variety of low BTU gases, preferably supplied directly from a gas pipeline. The slow speed of the engine, preferably around 600 RPM, results in low piston speeds and light bearing loads with very low wear rates.

The engine is adapted to be directly coupled to an oversized, equally slow speed heavy-duty brushless alternator which produces three phase AC at 30 Hz. The AC power is rectified to provide the desired DC voltage output for powering a station DC load in the range of 500 to 5,000 watts. The 500 to 5,000 watt range accounts for the majority of applications on new pipelines where multi-use stations are commonly employed to supply power for telecommunications, supervisory control and data acquisition, cathodic protection, and remote gate valve sensing and activation. The remote power system is capable of providing the entire 500 watt to 5,000 watt range in a single unit, thereby possessing a highly desirable expansion capability.

In accordance with the demands of the critical gas pipeline applications previously noted, the subject remote power system is adapted for continuous, twenty-four hour per day operation in harsh environments The invention is designed for six-month maintenance intervals with a comfortable margin.

The invention includes oversized lubricating oil tanks, oil filters, air filters and fuel filters to insure maximum cleanliness of the lubrication oil, combustion air and fuel for optimum engine performance and wear, thereby extending maintenance intervals to a minimum of six months.

The remote power system integrates fault tolerant design techniques to achieve unprecedented levels of reliability. In particular, internal redundancy is provided in critical areas, such as the provision of dual spark plug heads, high energy capacitive discharge solid state ignition systems, and redundant safety shutdown sensors and controls. Additionally, the invention utilizes a thermo syphon vapor phase type closed cycle cooling process. Moreover, sophisticated electronically activated controls are utilized to maintain precise optimum engine temperatures by controlling the electrical load and cooling system temperature so as to obtain maximum engine cleanliness, minimum engine pollutants, minimal engine wear, extended periods between routine maintenance visits and major overhauls, and greatly enhanced engine performance and life.

2. Description of the Prior Art

Several technical constraints serve to dictate the feasibility of power generating systems in gas pipeline applications. These technical constraints include remoteness of location, logistics of servicing and maintaining equipment, harsh environment, and need for reliability. The remote site locations typically affiliated with gas pipeline operations and similar remote locations make extension of the main power utility grid cost-prohibitive. Consequently, various technologies have been developed in an effort to provide cost-effective, reliable and easily maintainable power generating systems suitable for operation at remote sites in severe environments. The remote power technologies which currently receive general acceptance are the closed cycle vapor turbine, the high speed gas engine generator, the thermoelectric generator and the photovoltaic power system. Each of the presently accepted technologies exhibit numerous disadvantages in the 500 watt to 5,000 watt power range.

The closed cycle vapor turbine system is very inefficient, possessing an overall efficiency of only 3% to 4%. Hence, life cycle costs for such a system are prohibitively high, particularly for systems where power needs exceed 2,000 watts. Furthermore, the closed cycle vapor turbine relies on a vacuum to maintain rated output. Loss of vacuum through leakage or otherwise requires skilled personnel and sophisticated equipment to troubleshoot the cause and repair the deficiency in order to restore vacuum conditions. An even more serious potential problem affiliated with the closed cycle vapor turbine involves turbine seizure, requiring replacement of the approximately three hundred pound turbo alternator canister by personnel with the requisite expertise. The repair process frequently costs up to 30 percent of a new closed cycle vapor turbine. The present invention, on the other hand, is uniquely designed so that maintenance and repair tasks can be performed at the remote site by generally accessible and relatively unskilled personnel.

The natural gas high speed gas engine generator systems are also costly to maintain and operate. The high speed gas engine operates at 1800 RPM and, hence, is maintenance intensive, demanding frequent and costly maintenance protocols. All of the system's filters, fluids and tolerances must be professionally and carefully maintained within specified limits. Otherwise, the high stress levels will quickly cause major failures. The need for skilled maintenance becomes a serious problem at remote sites, where trained technicians are not likely to be readily available. In absence of monthly evaluation, the high speed engine is apt to deteriorate in a short time. Additionally, the high speed engine is generally incapable of withstanding continuous service in a hostile environment. Experience has shown that the systems tend to wear out quickly, culminating in frequent and expensive maintenance with random down times. The remote power system of the subject invention, in contrast, utilizes a slow speed engine to achieve reduced stress levels throughout the system with a drastic curtailment in maintenance requirements.

Although the overall reliability of a thermoelectric generator system may be high, the reliability of the system is sharply reduced in certain types of environments. Since the efficiency of the thermoelectric generator is directly related to the hot junction temperature, the system is deliberately designed to allow the hot junction temperature to come close to the thermoelement's maximum tolerable level. In view of the low inertia of the thermal system of the thermoelectric generator, any surplus heat is likely to bring the thermoelement into the danger zone very rapidly. The feasibility of the thermoelectric generator in high ambient environments is therefore compromised. Overheating is similarly likely to occur due to variations in the gas composition of the thermoelement caused by distillation of the light hydrocarbons in the gas or by a deviation from normal operating characteristics of the gas control components.

Another undesirable feature associated with thermal electric generators is that they are strictly limited to the peak rated capacity per individual thermoelectric generator module. Thus, in order to power larger loads, a number of units must be paralleled to arrive at the desired output capacity. Tee combination of multiple modules for greater output reduces the system Mean Time Between Failure by a factor equal to the number of generators utilized in the overall system. A multiple module power system is also more susceptible to overheating, as there is a greater likelihood that overheating of the thermoelement will ensue.

Each thermoelectric generator module is equipped with its own dedicated open flame combustion unit with control accessories and a very narrow cross-section burner orifice. This combustion system presents tee weakest link in an open flame thermoelectric generator. The combination of flameouts, orifice clogging, and internal pressure regulator variations are representative of ongoing reliability difficulties.

In contrast to the thermoelectric generator system, the remote power system of the present invention is characterized by a virtually unprecedented Mean Time Between Failure. Unlike the multi-module building block approach of the thermoelectric generator system, the invention is capable of providing from 500 to 5,000 watts output capacity without additional modules, equipment, or even adjustment. Indeed, since the parts count remains the same, a single unit is able to provide any amount of power over this range with the same high Mean Time Between Failure. Moreover, the invention does not require any sensitive energy conversion or combustion elements, nor does it employ any open flames.

Although a photovoltaic power system may be reliable and cost-effective for smaller loads, it too possesses a variety of technical disadvantages in the 500 to 5,000 watt output range. These disadvantages encompass allocation of physical space for the photovoltaic array, wind loading problems, and elaborate support structures and civil works requirements. The remote power system of the instant invention is free of the foregoing drawbacks, being relatively compact in physical size and of minimal complexity.

It is apparent from the preceding discussion that the need exists for a viable remote power system that is uniquely adapted for the 500 watt to 5,000 watt power output range, and which is specifically designed for highly reliable continuous operation at remote sites in harsh environments while requiring minimal and infrequent maintenance. The remote power system described and claimed in the present application addresses and fulfills this need by providing a remote power system which achieves essentially unsurpassed levels of reliability through a novel combination of components, gross derating of major subsystems, overall system simplification, and redundancy for key components.

SUMMARY OF THE INVENTION

The invention pertains to a power system specifically adapted for utilization at remote sites, particularly along gas pipelines, to provide electrical power for performing diverse functions and operations related, for example, to telecommunications, cathodic protection, data acquisition and remote valve sensing and activation. The remote power system comprises a slow speed heat engine directly coupled to an equally slow speed alternator. The heat engine is intended to be powered by any one of a number of gases and, preferably, derives its fuel directly from the applicable gas pipeline. The engine is adapted to operate at a slow 600 RPM speed, and is characterized by ceramic main bearings, redundant independent ignition systems, oversized lubricating oil sump, as well as vastly oversized fuel; oil and air filters, and a cooling system which utilizes stainless steel welded cooling piping between the engine and the cooling system heat exchanger. The engine is adapted to be started by hand by means of a hand crank, or with a portable starter, therefore not requiring an engine starting system add related components.

The 600 RPM engine is directly coupled to an oversized 1200 RPM alternator which is adapted to be operated at 600 RPM to produce AC power at 30 Hz. The system includes a rectifier for subsequently converting the AC power to a DC output for driving a 24 volt DC load in the range of 500 to 5,000 watts output capacity. The system specifically does not include any gear or belt drives. Because all of the AC power produced by the alternator is rectified, and since the DC load remains constant, engine speed control is not critical and an engine governor is not required. The air to fuel ratio for the engine is adapted to be adjusted in the factory prior to installation.

The engine cooling system includes, in addition to the superior cooling piping and heat exchanger, a fan motor which automatically controls the operation and speed of a heat exchanger fan in order to maintain the engine temperature at a consistently precise level The fan motor accomplishes this control in response to the engine temperature, as sensed by an electronic temperature sensor.

The remote power system engine is provided with a rotary magnetic encoder based engine speed sensor and pressure regulator controller. The speed sensor senses, monitors, and controls the engine speed by controlling a pressure regulator for the engine input gas. This eliminates the need for conventional and troublesome governors. The invention contemplates means for shutting down the engine upon the occurrence of certain critical conditions. The shutdown means is a redundant safety shutdown system, requiring activation of each shutdown sensor before the engine is actually shut down.

The unique characteristics of the remote power system enable it to achieve unparalleled levels of reliability for continuous operation at remote sites in harsh environments. Specifically, the remote power system is characterized by an unprecedented Mean time Between Failure rate of 20,000 hours, if not more. The remote power system further achieves increased life, is cost-effective, and requires minimal maintenance.

DESCRIPTION OF THE PREFERRED EMBODIMENT

Figure 1:
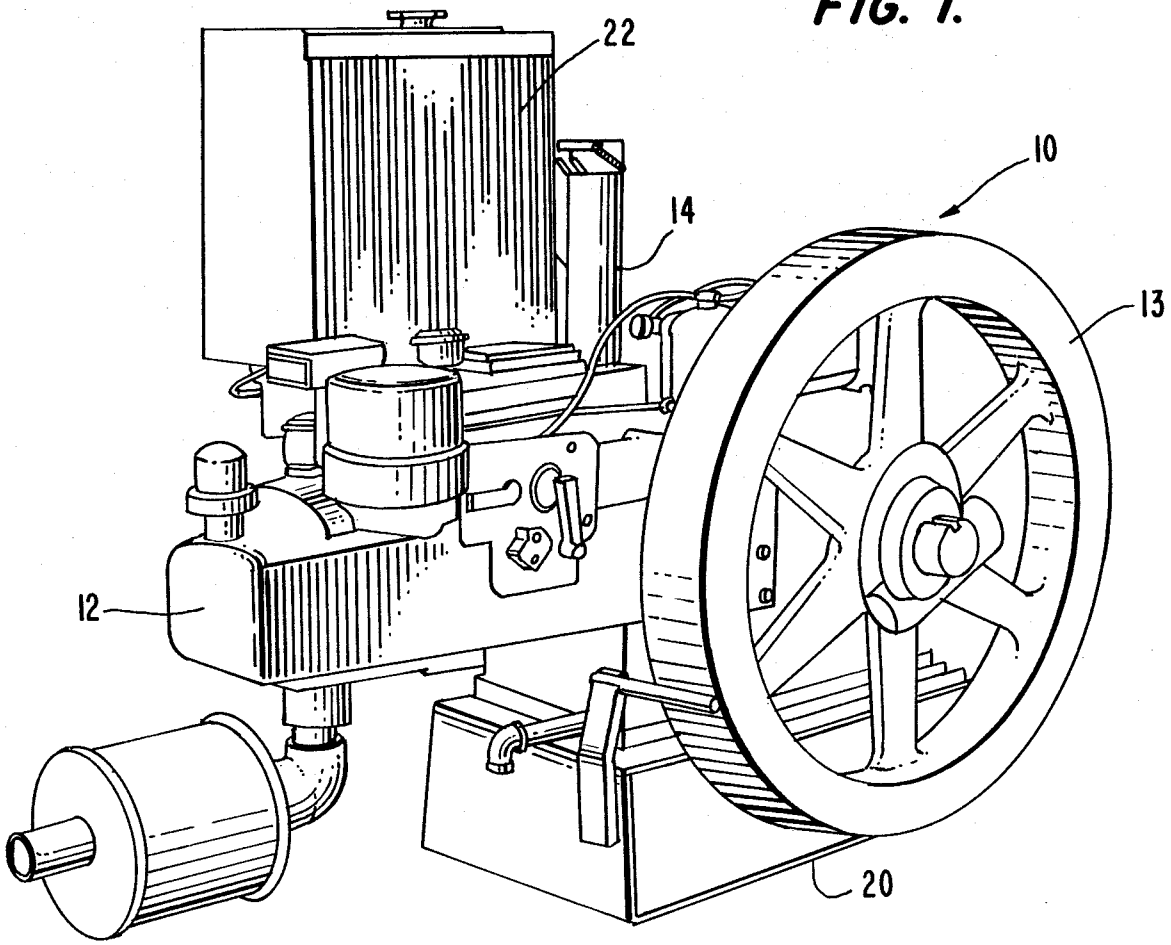
FIG. 1 is a perspective view of the remote power system.
Figure 2:
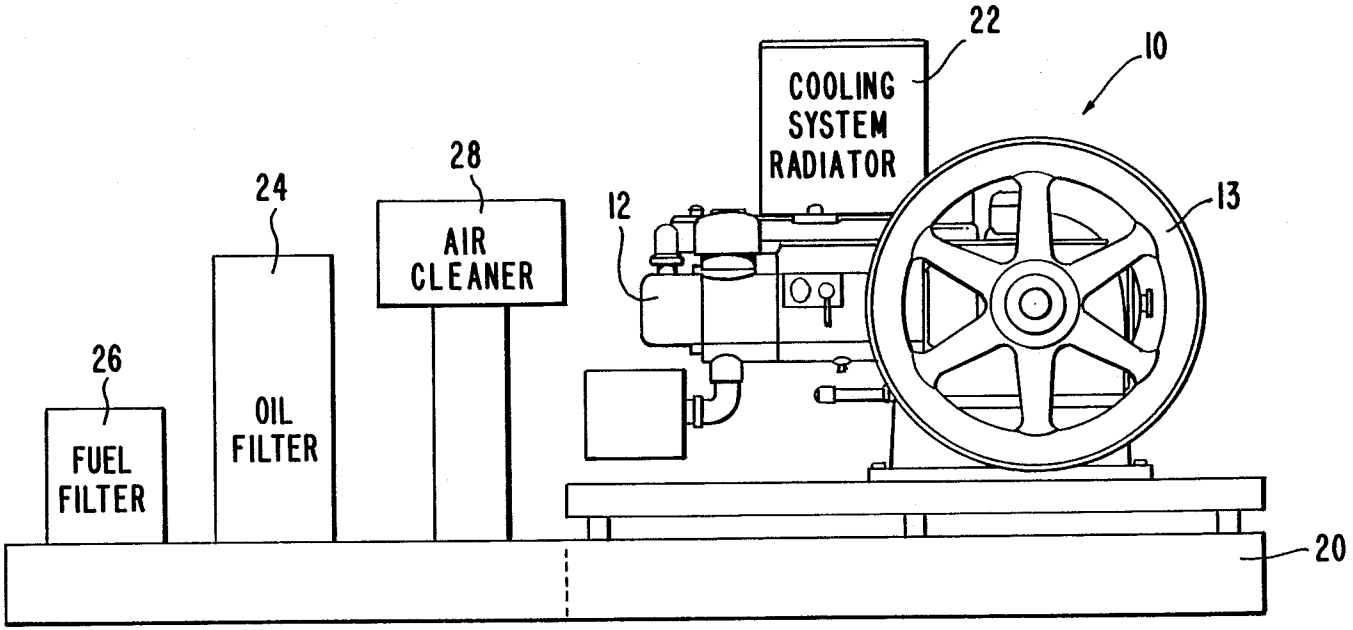
FIG. 2 is a front plan view of the remote power system.
Figure 3:
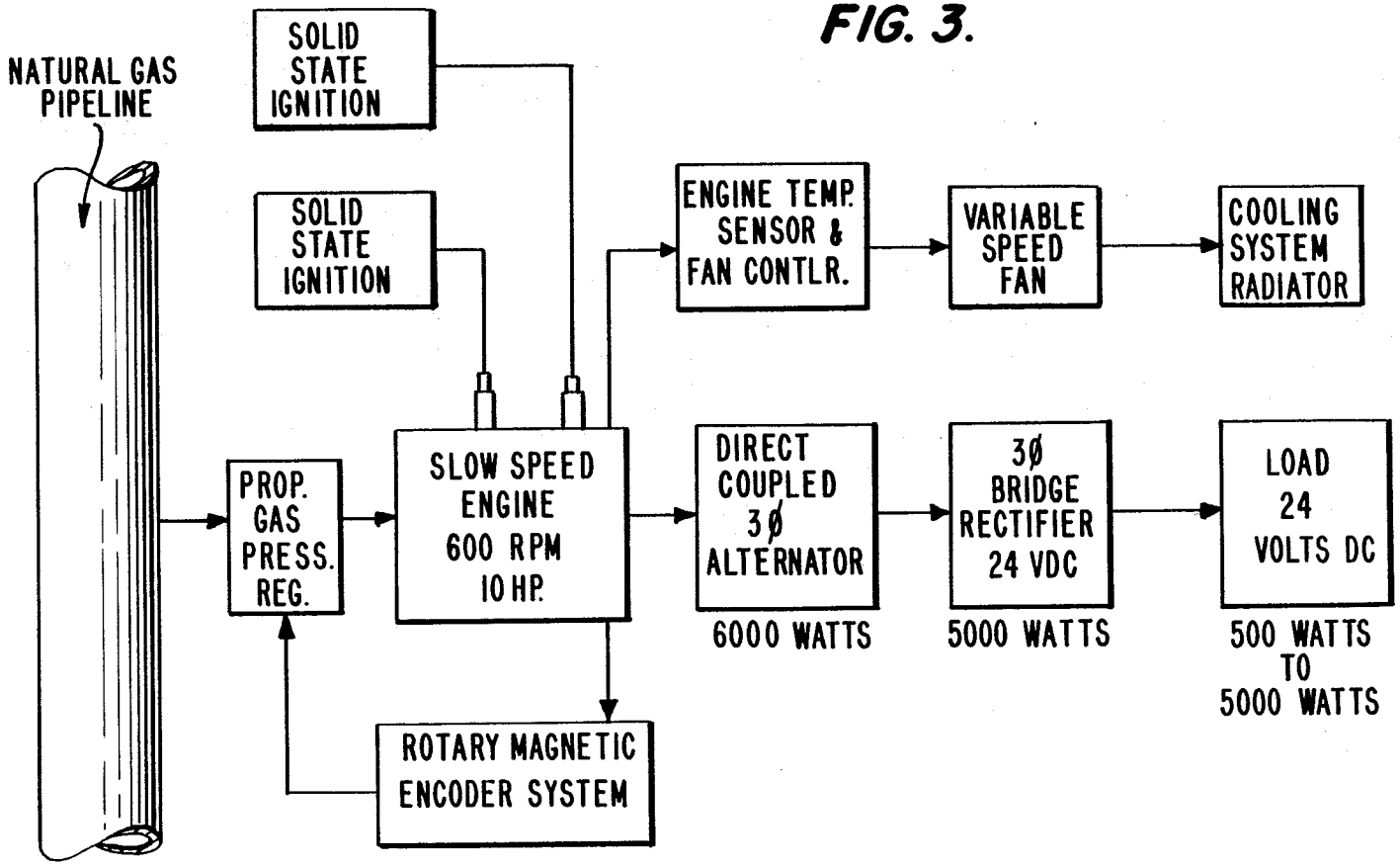
FIG. 3 is a flow chart depicting the relationship between the main components of the remote power system.

The preferred embodiment for the present invention is best understood and described in connection with the drawings of FIG. 1 and FIG. 2, and the flow chart of FIG. 3. As illustrated in FIGS. 1 and 2, and as displayed in the flow chart, the remote power system, indicated generally at 10, comprises a slow speed heat engine 12, having a flywheel directly coupled to an oversized slow speed alternator 14. The alternator is adapted to be coupled to the engine by any suitable coupling means, the exact coupling means not forming a critical part of the invention. The engine is preferably a 10 HP, 600 RPM horizontal cylinder, large displacement heat engine adapted to be powered by a low BTU gas, such as natural gas, wellhead gas, methane, butane or propane. The supply of input gas to the engine is controlled by means of a modulating type proportional natural gas fuel pressure regulator (not separately shown). The remote power system is specifically adapted for utilization in remote gas pipeline applications. It is intended, therefore, that the input gas be supplied to the engine directly from the pipeline, so as to afford a virtually cost-free supply of fuel.

The slow speed of the engine 12 results in low piston speeds, light bearing loads and an overall reduction in stress imposed on engine components. In actuality, the perceptible engine wear associated with engine 12 is at least five times lower than that for standard high speed engines utilized in conventional remote power generation systems. Unlike conventional engines, the engine, as utilized in the remote power system of the invention, specifically does not possess a starting motor, starting controls, starting battery and starting battery charger. Elimination of the latter components substantially improves system reliability, reduces maintenance costs and skill, markedly enhances initial price for the power system, simplifies manufacturing, shipping and installation, and significantly lowers overhaul requirements. The engine 12 is thus adapted to be started by hand by means of a hand crank, or with a portable 12 volt starter which may easily be transported to the site in an installation or maintenance vehicle.

The remote power system 10 is further uniquely characterized in that the alternator 14 is directly coupled to the engine 12 so as to eliminate potentially problematic gear boxes or belt drives and failure modes associated therewith. The alternator 14 is a heavy duty, three-phase, oversized and slow speed brushless alternator, being a 1200 RPM, 6 KW alternator. The alternator is adapted to be run at 600 RPM to produce 30 Hz rather than 60 Hz output, which is subsequently rectified for DC output applications. The slow speed, direct coupling and oversize features of the alternator result in a substantial increase in reliability and life of the alternator, as well as in a reduction in maintenance and overhaul demands. Bearing wear and heat build-up is also substantially alleviated, and failure weakness areas characteristic of gear box or belt drive systems are entirely eliminated.

Engine 12 includes, additionally, an ignition system (not separately shown) comprising redundant high energy, solid state, capacitive discharge ignition systems and dual spark plug heads utilizing extended-life platinum multi-electrode spark plugs. By providing redundancy for the aforementioned components, the remote power system is able to realize unprecedented reliability levels while extending periods between maintenance visits to a minimum of six months. The platinum spark plugs have approximately a 100 percent greater life span than plugs normally utilized in conventional engines. The plugs are also maintenance-free and do not require cleaning or regapping. Indeed, the electrode gap remains virtually unchanged throughout the life of the plug, in contrast to standard copper core plugs. Moreover, the heat rating of the plugs remains constant throughout their life.

The main bearings utilized in the engine 12 are superstrong ceramic bearings, preferably made from Syalon. Syalon has been found to be as hard as diamond, offering outstanding resistance to wear and heat. Utilizing bearings made from Syalon or like material, rather than conventional main bearings, results in 20 to 30 year life for the remote power system. With at least a 20 year longevity for the main bearings, the system does not require any complete overhauls. All of the other parts which are susceptible to wear are readily and easily replaceable in the field at lower cost with only rudimentary skill.

According to the principles of the invention, the alternator 14 produces an AC power output of 6,000 watts, 30 Hz, which is rectified by a three-phase bridge rectifier 18 to obtain a 24 volt DC, 500 to 5,000 watt power output capability. The resulting electrical power is adapted to operate or power a 24 volt station DC load (not shown) in the 500 watt to 5,000 watt power range, primarily for performing functions along remote gas pipelines and wells, specifically related to telecommunications, telecontrol, cathodic protection, supervisory control and data acquisition, and gate valve sensing and activation.

Because the entire AC power produced by the three-phase alternator is rectified by the three-phase bridge, engine speed is not a critical factor. Hence, engine 12 does not require a governor. Since the station DC load and, therefore, the engine load remain constant, the air to fuel ratio adjustment may be preset prior to installation, thereby guaranteeing relatively constant engine speed without the need for a governor. Elimination of an engine governor presents significant advantages, including improvement in system reliability and reduction in system cost and complexity. The level of skill required to maintain the system is also drastically reduced, allowing the power source to be easily maintained by a radio technician As shown in FIG. 2, a heavy duty skid base 20 is provided for the power system and, in particular, for the engine 12. The skid serves to dampen vibrations caused by the large displacement single cylinder heat engine 12 without requiring a very heavy and costly concrete foundation to be construed at the remote site. A very large stainless steel lubricating oil sump for the engine is built into the skid. The large built-in tank contributes a substantial amount of additional weight for stabilization of the system when the tank is filled with lubricating oil at the site. Alternatively, the skid may be filled with concrete at the factory to simplify site installation, and an external lubricating oil sump tank may be utilized instead of the built-in tank. The large built-in oil sump possesses the advantage of permitting the engine to run a minimum of six months before a change of lubricating oil or oil filter is necessitated. The stainless steel composition of the tank makes it impervious to the sulfuric acid by-products of the engine combustion.

Additional salient attributes of the lubricating system of the engine 12 include provision of a vertical forty-gallon oil filter as best depicted in FIG. 2, such as is normally utilized in a 1000 HP engine, and a grossly oversized fuel filter 26 and air filter, the air filter being about twenty times larger than normally required. These components contribute to realization of the extended maintenance interval scheme previously discussed herein., allowing minimum maintenance intervals of six months.

As noted above, the remote power system of the instant invention is particularly designed for continuous operation for six months (4380 hours), at which time the power system is intended to be shut down manually for routine maintenance. In order to realize this heretofore unavailable operation schedule, the support system components of the power system are extensively oversized in relation to components normally provided for a conventional power generator. Conventional support system components are fixed for approximately 500 hours of operation, which is the maximum anticipated running time for a conventional standby engine generator, and are unsuitable for the specific applications to which the invention is directed.

The engine 12 is provided with a cooling system (not separately shown) which comprises a cooling system radiator 22, as cooling system heat exchanger and argon-welded stainless steel coolant pipes for connecting the engine to the heat exchanger. Utilization of argon-welded stainless steel aircraft-type, flexible bellow-type coolant piping rather than the ordinary rubber hoses improves system reliability by eliminating one of the major areas of failure found in conventional water cooled engines. The piping utilized in the present invention provides positive containment of cooling and lubricating fluids, while eliminating potential fluid leaks associated with rubber coolant piping fatigue. The cooling system adopts a thermo syphon vapor phase type closed cycle cooling process which does not require a water pump. Eliminating the need for a water pump improves system reliability, reduces system cost and complexity, and reduces the level of skill required to maintain the system. The heat exchanger or radiator is cooled by a variable speed fan powered by a permanent magnet DC fan motor. The permanent magnet motor contributes to system reliability by automatically controlling the speed of the fan in order to maintain the engine at a precise 240° F. temperature, regardless of ambient temperature. The motor additionally enhances the reliability of the cooling system by obviating the need for a belt driven mechanical cooling system fan.

Operation of the cooling system fan in response to engine temperature is accomplished by means of electronic controls. In particular, an electronic temperature sensor is provided for monitoring the engine temperature, with electronic controls for controlling activation of the fan and fan speed. The electronic controls are specifically adapted to maintain the engine temperature at a "hot", optimum level, namely, 240° F., even under light electrical loading conditions, by electronically monitoring engine temperature so as to insure clean burning. Maintenance of the optimum temperature level is achieved by electronic activation and control of the cooling fan in response to the sensed temperature. In this manner, the engine is uniquely capable of obtaining maximum efficiency and cleanliness, with a concomitant curtailment in environmental pollution and extension of the useful life of the lubricating oil.

Engine speed is similarly maintained by means of electronic controls In particular, an electronically controlled, electromagnetic engine speed sensor/controller is provided to control the fuel pressure regulator in response to sensed engine speed. The fuel pressure regulator is preferably a modulating type proportional natural gas fuel pressure regulator which eliminates the need for a potentially troublesome constantly moving mechanical governor.

The remote power system is further provided with redundant safety shutdowns which are connected in parallel for sensing low oil level, high engine temperature and engine overspeed. Safety shutdown redundancy provides a fault tolerant design in the safety shutdown system for preventing false engine shutdowns in the event of a failure in one of the sensors. Both sensors must be activated before the engine will be shut down.

Conventional engine failure protection systems stop the engine upon the occurrence of certain sensed conditions, i.e., low oil pressure, high engine temperature and engine overspeed. Sensors which detect the foregoing conditions are typically activated when a predetermined value is surpassed. For example, upon detecting engine low oil pressure, the oil pressure sensor switch closes, an oil pressure relay coil is energized, oil pressure relay contacts close, an engine failure relay coil is energized, engine failure relay contacts close, and a fuel rack solenoid is energized to cut off fuel supply to the engine so that the engine stops.

If a sensor in a conventional system fails, the engine will experience a false shutdown. The latter is a very costly and undesirable event for a remote telecommunications station, representing as it does one of the more common failure modes for continuously running remote power generators. Additionally, a conventional system is characterized by at least three diverse sensors and, as such, the overall reduction in system reliability associated with conventional shutdown schemes is magnified, because a failure of any one sensor will result in false shutdown of the remote power system.

The present invention overcomes the drawbacks of a conventional shutdown system with respect to a remote power generator by providing twin sensors for each of the above-described safety shutdown functions. According to the invention, both sensors for any one function must be activated before fuel supply to the engine will be cut off. This redundant sensor activation requirement insures that the engine will not experience false stoppages through "nuisance trips" caused by a single sensor failure. In the event of an actual loss of engine oil pressure, for instance, both low oil pressure sensors will be activated and the engine will be shut down in the manner discussed in connection with a conventional system. Thus, the redundancy inherent in the present system fully and effectively protects the engine while achieving optimum availability/reliability of the remote power system.

The remote power system 10 is adapted to be disposed within a one-piece molded fiberglass enclosure (not shown) with two lift-off doors. The enclosure presents an aesthetically attractive outer structure and provides additional protection for the power system due to its weatherproof qualities. The lift-off doors allow easy and convenient access to the power system.

It is apparent from the foregoing that the invention emphasizes reduced overall stress levels, potential failures and maintenance, with accompanying achievements in reliability and cost. Indeed, a major design goal for the remote power system of the invention was a Mean Time Between Failure in excess of 20,000 hours. While this is a difficult objective for any continuous power system that operates in remote areas, the unique design of the invention enables it to meet or exceed this goal. The remote power system operates at slow speeds and utilizes vastly over-designed components to reduce stress levels to a fraction of the component's rating. Every component and subsystem is designed to be as simple in operation, maintenance and repair as possible. The incorporation of microprocessor based electronic control provides for optimum engine conditions. By reducing the system's complexity through low stress levels and a unique design approach, the remote power system affords a combination of reliability and cost incentives not found in conventional devices.

While the invention has been described in connection with a preferred embodiment, it is to be understood that various adjustments, modifications and changes may be made to the preferred embodiment discussed herein without departing from the spirit and scope of the invention as defined by the appended claims, including the use of slow speed liquid fueled engines.

What is claimed is:

1. A remote power system comprising a slow speed engine, a slow speed alternator adapted to be directly coupled to said engine for producing AC power, a rectifier for converting said AC power to a DC power output, said DC output being adapted to power a load, said engine being adapted to be powered by a fuel, a pressure regulator controlling the supply of said fuel to said engine, redundant independent ignition systems provided for said engine, a cooling system provided for said engine, said cooling system including a heat exchanger, a fan, a fan motor for operating said fan and welded stainless steel cooling pipes for connecting said engine to said heat exchanger, means for sensing the temperature of said engine, the operation of said fan being controlled automatically to maintain said engine at an optimum predetermined temperature in response to said sensed temperature, a lubricating system provided for said engine, said lubricating system including an oversized lubricating oil sump, oil filter, fuel filter, and air filter, a rotary magnetic encoder system for sensing the speed of said engine and for controlling operation of said pressure regulator in response to said sensed speed to maintain engine speed, and redundant safety shutdown systems for shutting down said engine by cutting off said supply of said fuel when the oil pressure for said power system is lower than desired, when said sensed engine temperature is higher than desired or when said sensed speed of said engine is higher than desired, each of said shutdown means being required to be activated in order to shut down said engine.

2. The remote power system recited in claim 1 wherein said engine is a 10 HP, 600 RPM, horizontal cylinder, large displacement engine.

3. The remote power system recited in claim 1 wherein said fuel for powering said engine is a low BTU gas such as natural gas, wellhead gas, methane, butane, propane and the like.

4. The remote power system recited in claim 1 wherein said fuel for powering said engine is obtained directly from a gas pipeline.

5. The remote power system recited in claim 1 wherein said alternator is a 6 KW, 1200 RPM, three-phase brushless alternator, said alternator being adapted to be operated at 600 RPM.

6. The remote power system recited in claim 1 wherein said engine is provided with ceramic main bearings.

7. The remote power system recited in claim 1 wherein an air to fuel ratio for said engine is adapted to be preset, such that said engine does not possess a governor.

8. The remote power system recited in claim 1 wherein said engine is adapted to be started by means of a hand crank or a portable starter means, such that said engine does not possess a starting system.

9. The remote power system recited in claim 1 wherein said rectifier is a 24 Volt DC, three-phase bridge rectifier.

10. The remote power system recited in claim 1 wherein said ignition systems include dual platinum multi-electrode spark plugs.

11. The remote power system recited in claim 1 wherein said fan is a variable speed fan and said fan motor is a permanent magnet DC fan motor, said operation of said fan being controlled to maintain said engine at a precise 240° F. temperature.

12. The remote power system recited in claim 1 further comprising a heavy duty oil field skid base.

13. The remote power system recited in claim 12 wherein said lubricating oil sump is a stainless steel tank built into said base.

14. A remote power system comprising a 600 RPM slow speed heat engine, a 1200 RPM three-phase alternator adapted to be directly coupled to said engine to operate at 600 RPM for producing AC power, a bridge rectifier for converting said AC power to a DC power output, said DC output being adapted to power a load, said engine being adapted to be powered by a fuel, a modulating type proportional gas fuel pressure regulator for controlling the supply of said fuel to said engine, a three-phase alternator, redundant independent ignition systems provided for said engine said ignition systems including dual platinum spark plugs and dual solid state ignition subsystems, ceramic main bearings provided for said engine, a cooling system provided for said engine, said cooling system including a heat exchanger, a variable speed fan, a permanent magnet DC fan motor for operating said fan and argon-welded stainless steel cooling pipes for connecting said engine to said heat exchanger, electronic means for sensing the temperature of said engine, means for automatically controlling the operation and speed of said fan in response to said sensed temperature to maintain said engine temperature at about 240° F., a lubricating system provided for said engine, said lubricating system including an oversized lubricating oil sump, a forty-gallon oil filter, an air cleaner that is oversized by a factor of approximately twenty and an oversized fuel filter, a rotary magnetic encoder system for sensing the speed of said engine and for controlling operation of said pressure regulator in response to said sensed speed to maintain engine speed, and redundant safety shutdown systems for shutting down said engine by cutting off said supply of said fuel when the oil pressure for said power system is lower than desired, when said sensed engine temperature is higher than desired or when said sensed speed of said engine is higher than desired, each of said shutdown means being required to be activated in order to shut down said engine.

15. The remote power system recited in claim 14 wherein said bearings are made from Syalon.

16. The remote power system recited in claim 14 wherein an air to fuel ratio for said engine is adapted to be preset, such that said engine does not possess a governor.

17. The remote power system recited n claim 14 wherein said engine is adapted to be started by means of a hand crank or a portable starter means, such that said engine does not possess a starting system.

18. The remote power system recited in claim 14 further comprising a heavy duty oil field skid base.

19. A power system for utilization at a remote gas pipeline comprising a 600 RPM slow speed heat engine, a 1200 RPM three-phase alternator adapted to be directly coupled to said engine to operate at 600 RPM for producing AC power, a three-phase bridge rectifier for converting said AC power to a DC power output, said D output being adapted to power a 24 volt DC load in the range of 500 to 5,000 watts, said engine being adapted to be powered directly by gas from said gas pipeline, said engine being adapted to be started by means of a hand crank or by means of a portable starter whereby said engine does not include a starting system, said engine having a preset air to fuel ratio whereby said engine does not require a governor, a pressure regulator for controlling the supply of said gas to said engine, redundant independent ignition systems provided for said engine, ceramic main bearings for said engine, a cooling system provided for said engine, said cooling system including a heat exchanger, a variable speed fan, a motor for operating said fan and welded stainless steel cooling pipes for connecting said engine to said heat exchanger, said cooling system utilizing a thermo syphon vapor phase type closed cycle cooling process whereby a water pump is not provided, electronic means for sensing the temperature of said engine, means for automatically controlling the operation and speed of said fan in response to said sensed temperature to maintain said engine temperature at about 240° F., a lubricating system provided for said engine, said lubricating system including an oversized lubricating oil sump, oil filter, air cleaner and fuel filter, a rotary magnetic encoder system for sensing the speed of said engine and for controlling operation of said pressure regulator in response to said sensed speed to maintain engine speed, redundant safety shutdown systems for shutting down said engine by cutting off said supply of said fuel when the oil pressure for said power system is lower than desired, when said sensed engine temperature is higher than desired or when said sensed speed of said engine is higher than desired, each of said shutdown means being required to be activated in order to shut down said engine, and an oil field skid base provided for said power system, said remote power system being characterized by a Mean Time Between Failure at least equal to 20,000 hours.

20. The remote power system recited in claim 19 wherein said sump is a stainless steel tank built into said skid.

* * * * *